US009897401B2

(12) United States Patent
Suchard

(10) Patent No.: US 9,897,401 B2
(45) Date of Patent: Feb. 20, 2018

(54) CHEMICAL CLEANING OF FURNACES, HEATERS AND BOILERS DURING THEIR OPERATION

(71) Applicant: SENTRO Technologies USA, LLC, Irvine, CA (US)

(72) Inventor: Talmor Suchard, Irvine, CA (US)

(73) Assignee: SENTRO Technologies USA, LLC, Irvine, CA (US)

( * ) Notice: Subject to any disclaimer, the term of this patent is extended or adjusted under 35 U.S.C. 154(b) by 0 days.

(21) Appl. No.: 15/330,366

(22) Filed: Sep. 13, 2016

(65) Prior Publication Data

US 2017/0089651 A1 Mar. 30, 2017

Related U.S. Application Data

(60) Provisional application No. 62/234,708, filed on Sep. 30, 2015.

(51) Int. Cl.

| | |
|---|---|
| ***B08B 7/00*** | (2006.01) |
| ***F28G 9/00*** | (2006.01) |
| ***C11D 17/00*** | (2006.01) |
| ***C11D 11/00*** | (2006.01) |
| ***C11D 7/32*** | (2006.01) |
| ***C11D 7/20*** | (2006.01) |
| ***C11D 17/06*** | (2006.01) |
| ***F28G 1/16*** | (2006.01) |
| *B05B 7/14* | (2006.01) |
| *B08B 9/093* | (2006.01) |

(52) U.S. Cl.

CPC ..... *F28G 9/00* (2013.01); *C11D 7/20* (2013.01); *C11D 7/3272* (2013.01); *C11D 7/3281* (2013.01); *C11D 11/0041* (2013.01); *C11D 17/0043* (2013.01); *C11D 17/06* (2013.01); *F28G 1/166* (2013.01); *B05B 7/1486* (2013.01); *B08B 9/093* (2013.01)

(58) Field of Classification Search

CPC ..... F28G 9/00; B08B 9/093; C11D 7/20

See application file for complete search history.

(56) References Cited

U.S. PATENT DOCUMENTS

2010/0081606 A1* 4/2010 Barger ..... C11D 3/044 510/397

* cited by examiner

*Primary Examiner* — Sharidan Carrillo

(74) *Attorney, Agent, or Firm* — Pearl Cohen Zedek Latzer Baratz LLP

(57) ABSTRACT

The present invention comprises a waterless mixture which includes a biuret and/or urea, silica, and melamine particles coated with a layer of magnetite iron oxide for cleaning furnaces, heaters or boilers. A typical cleaning mixture comprises 30-50 percent silica, 20-50 percent biuret and/or urea, 20-40 percent melamine and 1-5 percent iron oxide. The cleaning can be performed at any time. This may lead to a reduction in fuel consumption, less air pollution, increased throughputs, and avoidance of equipment damage.

5 Claims, 7 Drawing Sheets

CHEMICAL CLEANING OF FURNACES, HEATERS AND BOILERS DURING THEIR OPERATION

CHEMICAL CLEANING OF FURNACES, HEATERS AND BOILERS DURING THEIR OPERATION

CHEMICAL CLEANING OF FURNACES, HEATERS AND BOILERS DURING THEIR OPERATION

Example of spraying lance sizes

Example of spraying lance lengths

Example of spraying lance directions

Example of spraying lance dispersion

Example of spraying combination

CHEMICAL CLEANING OF FURNACES, HEATERS AND BOILERS DURING THEIR OPERATION

CROSS REFERENCE TO RELATED APPLICATIONS

The present application claims priority from U.S. Provisional Patent Application No. 62/234,708, filed Sep. 30, 2015 which is incorporated herein by reference.

FIELD OF THE INVENTION

The present invention relates to cleaning of sediments and fuel remaining and in particular, to cleaning of furnaces, heaters and boilers during their operation.

BACKGROUND

Furnaces, heaters and boilers can be found in many industries such as oil refineries, petrochemical, chemical, nuclear and geothermal.

Furnaces, heaters and boilers are being used for supply of energy. Although their design may vary according to requirements of throughput, thermal conditions, fuel, building materials etc., in most cases there are some common features:

There exist a burning of a fuel with air in a combustion chamber; the air is usually supplied by a blower and the fuel enters the burning chamber through a burner. In some cases a number of burners are arranged in a structure. There exist burners mounted from different directions: from top, bottom or of the sides of the combustion chamber.

The energy of the combustion is being transferred to a fluid which flows inside enclosed tubes that are installed in the radiant section, (sometimes called "firebox"). There exist various designs of radiant sections where which tubes may be installed in many ways: vertically, horizontally, along the walls, in the middle of the firebox, and etc. After being heated, the fluid typically flows in a form of gas to a process unit which can be heat exchanger, distillation, separation or reaction where the thermal energy of the fluid can be used for distillation, separation or transferred in order to accomplish desired purpose which can be heating another process fluid, supply of energy to a reaction mixture in a chemical facility etc. In some cases, the use of a heating fluid is intended to avoid vigorous heating generated by the heat of combustion which might result in a poor control of the heat transferring process. In boilers the heated fluid is water and the product is high pressurized steam. The combustion gases (flue gases), either to be emitted or pass first through a heat recovery system, (sometimes called "convection section" or "economizer"). There are some designs where in the convection section are installed finned tubes or studded tubes to facilitate more efficient transfer of heat from the flue gases to the fluid.

Over the time, both in the radiant and in the convection sections, fuel sediments or other materials such as dust or mud that are sucked by the negative pressure that is created by the stack, are accumulated on the outside walls of the process tubes. This causes reduction in the efficiency of the heat transfer and increase in fuel consumptions and air pollution. It can also lead to problems of throughput and of process control as well as equipment damage. Scale which has high acidic or high basic pH can cause intensive corrosion of the process tube walls, which shorten the tubes work life.

Existing methods for cleaning furnaces, heaters and boilers include: sandblasting, high pressure water blasting, dry ice blasting, applying chemical agents and using steel brushes or sand paper. The present methods require inter alia a shutting down of equipment, production breaks and use of scaffolds. Those non-productive activities are leading to substantial loss of time, costs, safety hazards and disturbance in production plans.

There is a long time need to overcome the above mentioned disadvantages and negative impacts of the existing art.

SUMMARY

The present inventor had found a method that overcomes the drawbacks of the existing art that were mentioned above. The present invention is applicable for any type and size of furnaces or boiler such as square or cylindrical, with horizontal or vertical tubes and with or without convection section or economizer. The cleaning can be performed on both radiant section and convection section of the furnace or boiler as well as on the incoming air pre-heater, the economizer, the super heater and other parts of the furnace or boiler.

The present invention does not require shut off of equipment, the production is unaffected and the cleaning can be performed at any time. Further advantages using the present invention are:

1. It is a waterless cleaning method. In this way corrosion is avoided to metal parts and no need for waste water treatment.
2. No damage to equipment parts as result of using in high pressure blasting sand or pressurized water jet in accordance with existing techniques.
3. The cleaning is done from the outside. Neither there is a need to enter the furnace or boiler nor to use scaffolds.
4. In contrast to using fluid flow, the use of solid and dry particles flow, allows penetration to deep parts of the structure.
5. There is no risk of damage to equipment caused by thermal shocks associated in using of dry ice.
6. Minimal health hazards and minimal negative environmental impact when compared of using hazardous chemical agents according to existing art.
7. Cleaning of both inorganic and organic sediments, by dual effect of mild erosion and a chemical reaction of the non-hazardous compounds with the organic sediments.

The present invention facilitates benefits of increased thermal efficiency in the heat transfer process due to the ability to perform cleaning at any time. This leads to reduction in fuel consumption, less air pollution, increased throughputs and avoidance of equipment damage.

The present invention comprises using biuret or urea, silica and melamine particles coated with thin layer of magnetite iron oxide.

Biuret is a chemical compound with the below chemical formula. It is the result of condensation of two molecules of urea.

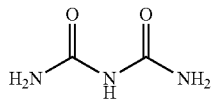

Biuret appears as a white solid, soluble in hot water. A variety of organic derivatives are possible. For example, dimethyl biuret with the following formula: $CH_3HN—CO—NR'—CO—NHCH_3$. The term "biuret" describes also a family of organic compounds with the functional group $—(HN—CO—)_2N—$.

Industrial sand and gravel, often called "silica," "silica sand," and "quartz sand," includes sands and gravels with high silicon dioxide (SiO2) content. Silica (SiO2), is used as a mineral abrasive in sandblasting for cleaning industrial as well as commercial structures.

Melamine is an organic base and a trimer of cyanamide, with a 1,3,5-triazine skeleton shown in the below formula. It contains 67% of nitrogen, (mass), and if is mixed with resins, has fire retardant properties due to its release of nitrogen gas when burned or charred.

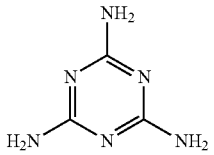

According an embodiment of the present invention, it is possible to apply a variety of ratios of biuret or urea, silica and melamine and different sizes of particles depending on the required physical strength of the particles and in accordance to the cleaning task. For example higher melamine ratio promotes higher particle strength and higher heat resistance. A typical composition of the cleaning mixture shall be 30-50% silica, 20-50% biuret, 20-40% melamine and 1-5% iron oxide. According to another aspect of the present invention, biuret may be substituted by urea.

Larger particles are more resistant to heat. Particle size according to an embodiment of the present invention can vary from approximately 0.8 mm to approximately 2.5 mm.

The magnetite iron oxide coating is intended to increase the particles' heat resistance and to fill microscopic pores and cracks on metal surfaces during the cleaning process as passivation agent that promote corrosion resistance of metal parts. The thickness of the magnetite iron oxide coating, according to an embodiment of the present invention, can vary from an approximately 10 to an approximately 100 microns depending on the requirement of the particles' heat resistance.

DETAILED DESCRIPTION

Figure 1:
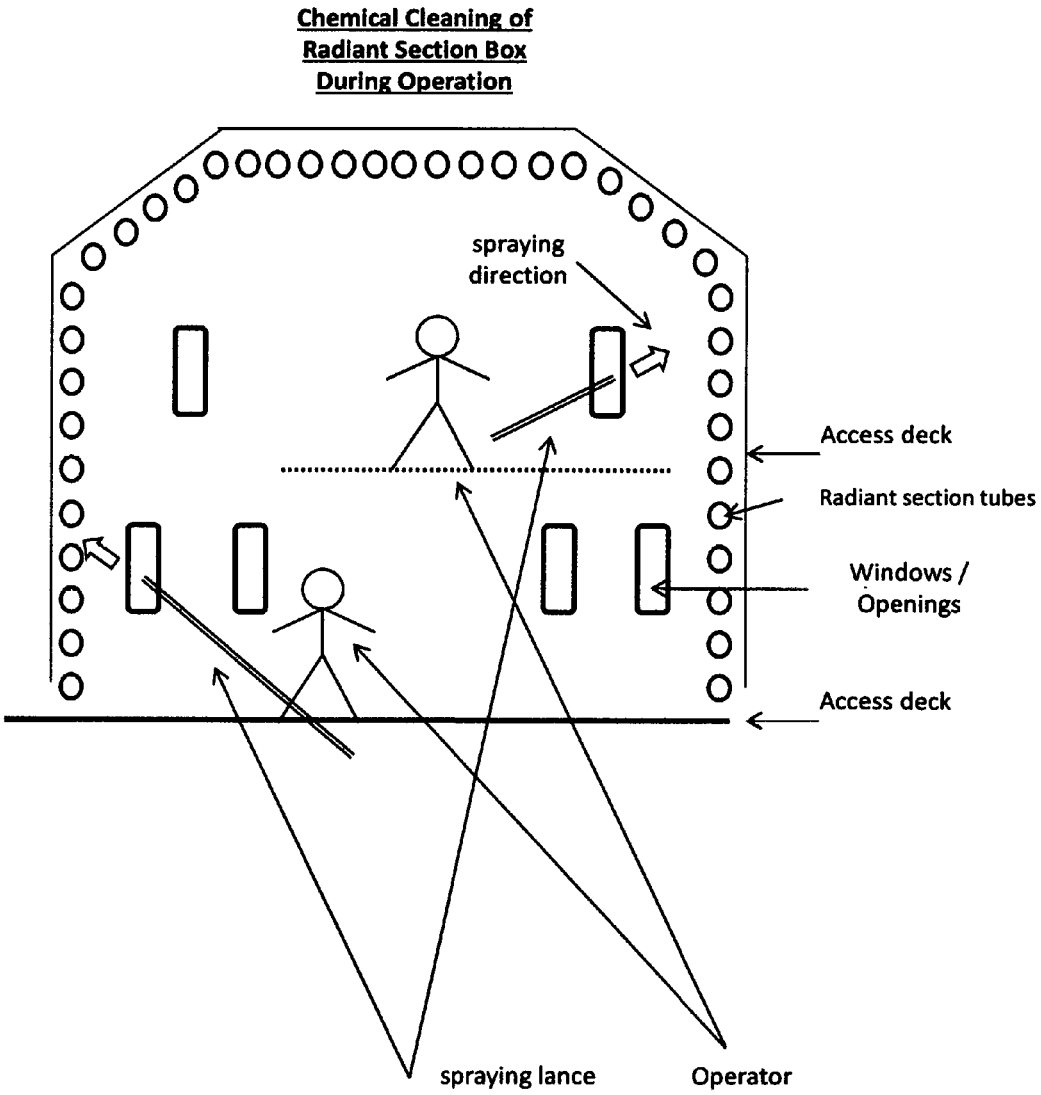
FIG. 1 is a schematic illustration showing some structural features according to an aspect of the present invention related to cleaning of a radiant section.
Figure 2:
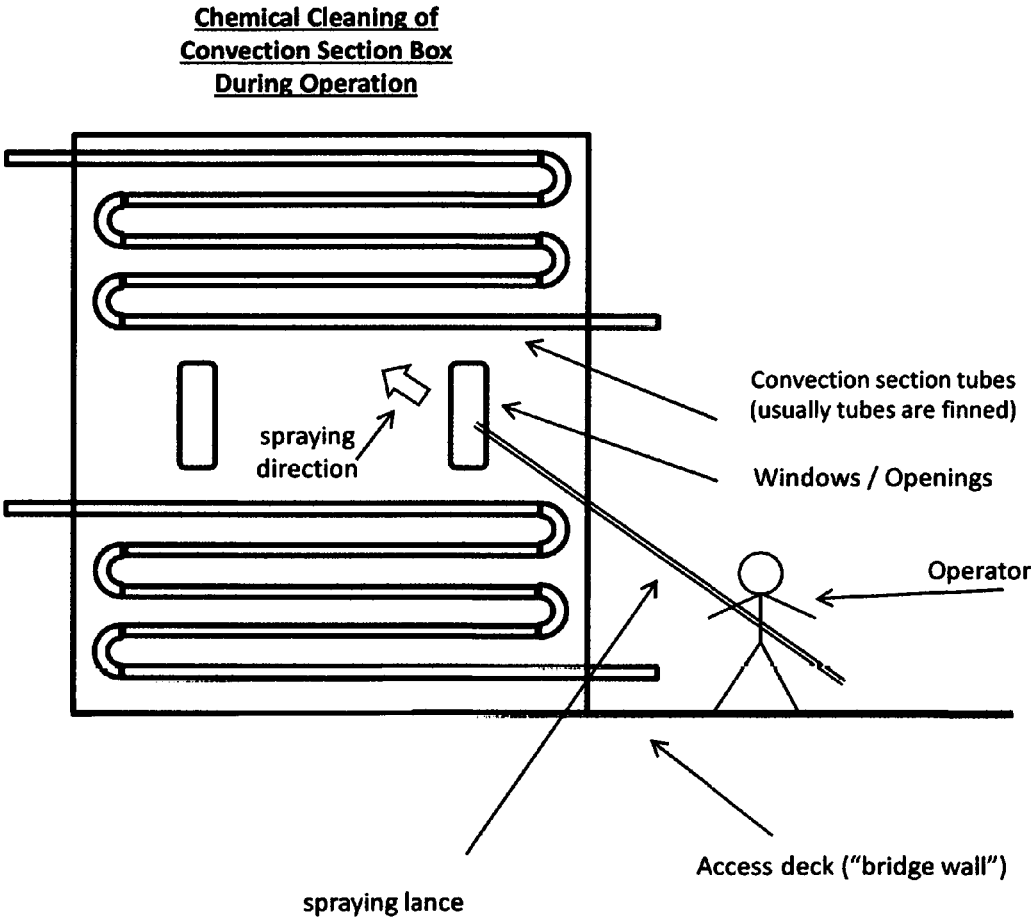
FIG. 2 is a schematic illustration showing some structural features according to an aspect of the present invention related to cleaning of a convection section.
Figure 3:
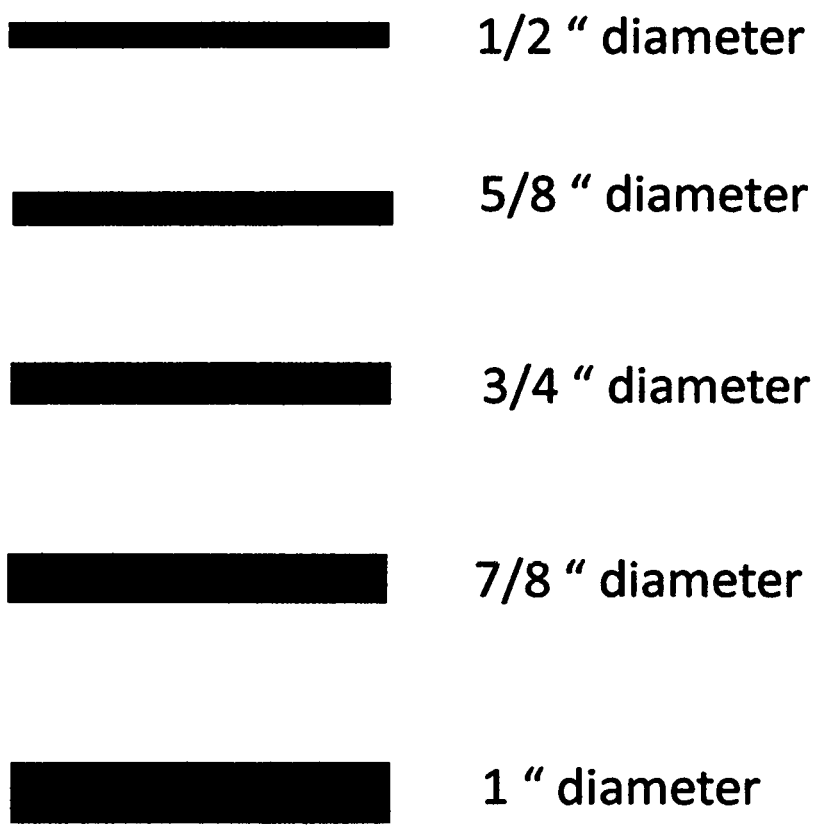
FIG. 3*a, b, c, d, e* are schematic illustrations showing some structural features according to an aspect of the present invention related to equipment used to spray the cleaning mixture.
Figure 3:
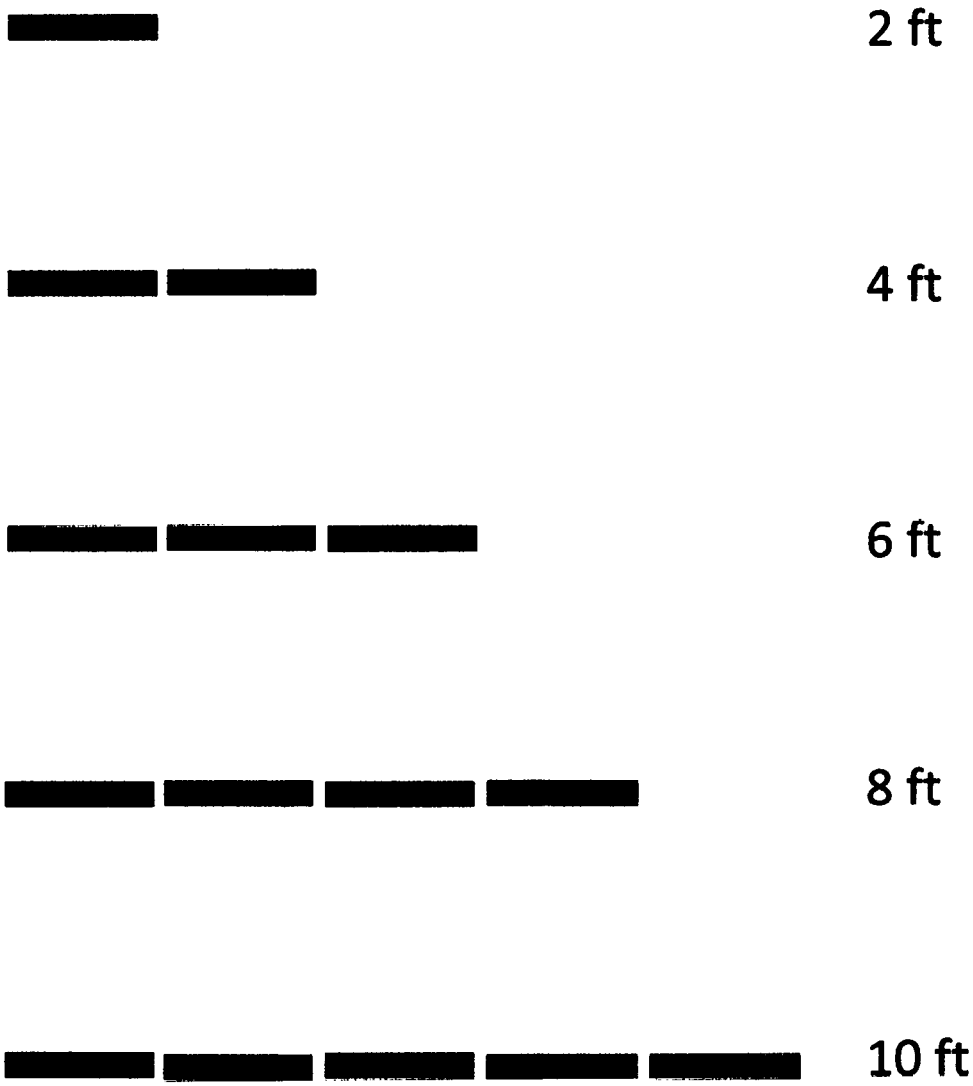
Figure 3:
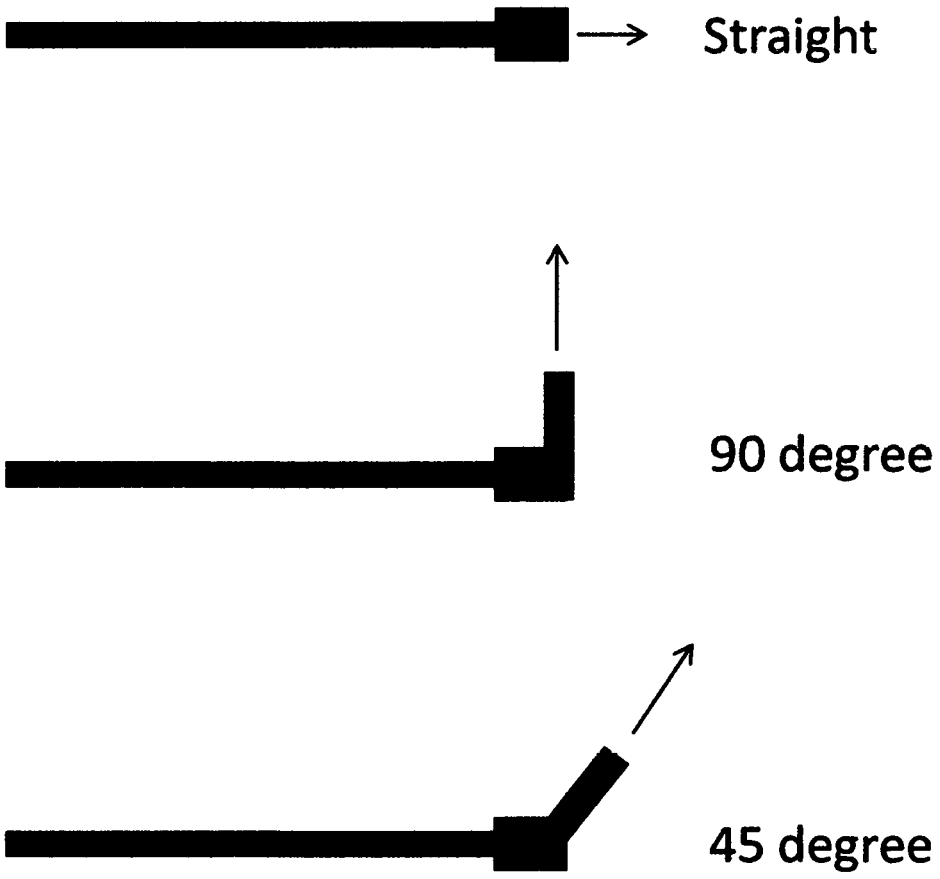
Figure 3:
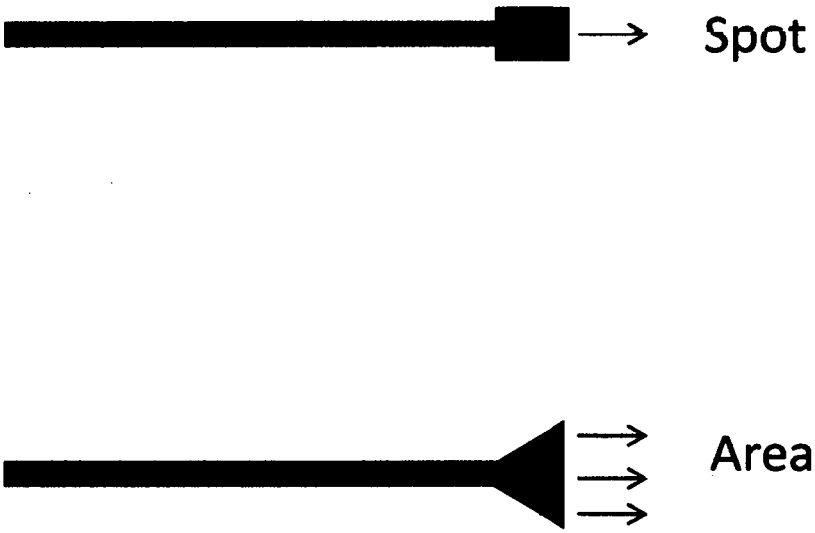
Figure 3:
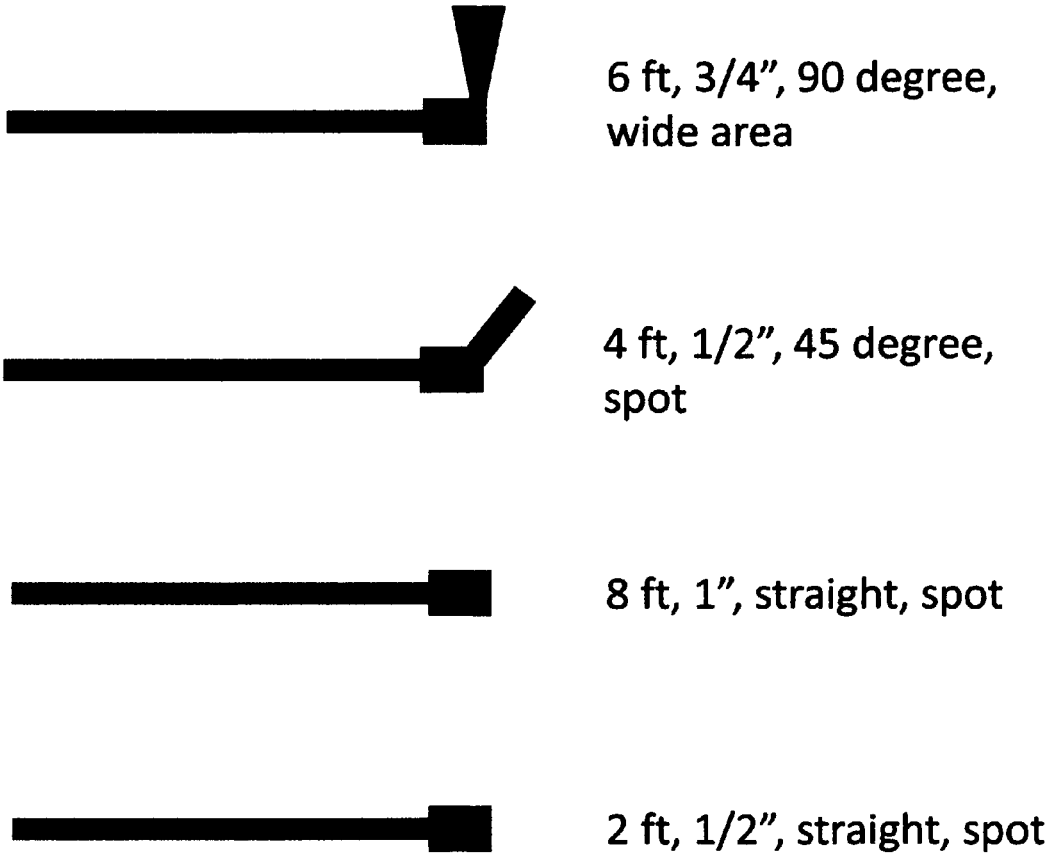

The present inventor had found a method that overcomes the drawbacks of the existing art that were mentioned above. The present invention is applicable for any size and type of furnaces such as square or cylindrical, with horizontal or vertical tubes and with convection section. The cleaning can be performed on both radiant section and convection section of the furnace or boiler as well as on the incoming air pre-heater, the economizer, the super heater and other parts of the furnace.

The present invention does not require shut off of equipment, the production is unaffected and the cleaning can be performed at any time. Further advantages using the present invention are:

1. It is a waterless cleaning method. In this way corrosion and thermal shock is avoided to metal parts and no need for waste water treatment.
2. No damage to equipment parts by mechanical shear stresses as result of using in blasting sand or water in accordance with existing techniques.
3. The cleaning is done from the outside. Neither there is a need to enter the furnace or boiler nor to use scaffolds.
4. In contrast to using fluid flow, the use of solid and dry particles flow, allows penetration to deep parts of the construction.
5. There is no risk of damage to equipment caused by thermal shocks associated in using of dry ice.
6. Minimal health hazards and minimal negative environmental impact when compared of using hazardous chemical agents according to existing art.
7. Cleaning of both inorganic and organic sediments, by dual effect of mild erosion and a chemical reaction of the non-hazardous compounds with the organic sediments.

The present invention facilitates benefits of increased thermal efficiency in the heat transfer process due to the ability to perform cleaning at any time. This leads to reduction in fuel consumption, less air pollution, increased throughputs and avoidance of equipment damage.

The present invention comprises using biuret or urea and melamine and silica particles coated with thin layer of magnetite iron oxide.

Biuret is a chemical compound with the below chemical formula. It is the result of condensation of two molecules of urea.

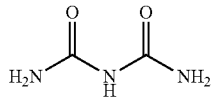

Biuret appears as a white solid, soluble in hot water. A variety of organic derivatives are possible. For example, dimethyl biuret with the following formula: $CH_3HN—CO—NR'—CO—NHCH_3$. The term "biuret" describes also a family of organic compounds with the functional group $—(HN—CO—)_2N—$.

Industrial sand and gravel, often called "silica," "silica sand," and "quartz sand," includes sands and gravels with high silicon dioxide (SiO2) content. Silica (SiO2), is used as a mineral abrasive in sandblasting for cleaning industrial as well as commercial structures.

Melamine is an organic base and a trimer of cyanamide, with a 1,3,5-triazine skeleton shown in the below formula. It contains 67% of nitrogen, (mass), and if is mixed with resins, has fire retardant properties due to its release of nitrogen gas when burned or charred.

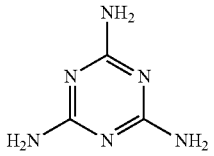

According an embodiment of the present invention, it is possible to apply a variety of ratios of biuret or urea, silica and melamine and different sizes of particles depending on the required physical strength of the particles and in accordance to the cleaning task. Particle size according to an embodiment of the present invention can vary from approximately 0.8 mm to approximately 3.5 mm.

A typical composition of the cleaning mixture shall be 30-50% silica, 20-50% biuret, 20-50% melamine and 1-5% iron oxide. According to another aspect of the present invention, biuret may be substituted by urea. According to yet another aspect of the present invention, the cleaning mixture may comprise both biuret and urea.

According to an embodiment of the present invention higher melamine content in the cleaning mixture contributes to the mechanical strength of the mixture particle as well their heat resistance due to the fire retardant characteristics of the melamine. Higher heat resistance may be achieved also by using larger particles and using magnetite iron oxide coating. Magnetite iron oxide coating is used also in order to fill microscopic pores and cracks on metal surfaces during the cleaning process as passivation agent that promote corrosion resistance of metal parts. The thickness of the magnetite iron oxide coating, according to an embodiment of the present invention, can vary from an approximately 10 to an approximately 100 micron depending on the requirement of the particles' heat resistance. For example according to a preferred embodiment of the present invention in large furnaces, when the particles may travel more than 20 meters inside the furnace, or in very hot furnaces, where the radiant cell temperature rises above approximately of 900° C., typical size of particles may be at a range of 1.8 to 3.4 mm; melamine content can reach 60% and magnetite iron oxide coating thickness can reach approximately 80 microns. Other examples when higher heat resistance is required is when according to the operating setting of the furnace, the flames are very close to the furnace walls or when the cleaning mixture is sprayed through the flames.

According to an embodiment of the present invention, the content of silica in the cleaning mixture will be higher when there is a need for more aggressive cleaning. For example, when the chemical effect of the cleaning mixture is limited when required to clean materials with low reactivity. Another case when it is desirable to increase the silica content in the cleaning mixture is when there is a need to clean iron compounds such as iron sulfide or iron oxide.

When there is a need for cleaning acidic sediments such as containing sulphur or vanadium higher content of biuret (or urea) may be used. In some applications embodying the principles of the present invention, biuret (or urea) content may reach even up to around 95% in the cleaning mixture content.

The below explanations concerning using the present invention will reveal a possible application embodying the principles of the present invention.

In a cleaning of convection section of furnace, typical equipment in a cleaning system according to an embodiment of the present invention shall comprise: a blasting machine operating at a pressure of 80-200 psi; supply of 400 to 1600 CFM of compressed air at a required pressure; Water separator ("moisture trap") that is installed at the inlet of the blasting machine; set of spray hoses, control equipment, lances and tips. The compressed air pressure may be adjusted according to requirements related to the structure that need to be cleaned such as height, depth, volume and complexity.

In accordance to an embodiment of the present invention, for cleaning of a convection section, the lances lengths can vary from approximately 25 cm to approximately 2.5 m. The diameter can vary from approximately ¼" to an approximately 1½". Diameters may be determined also in accordance with structural features. In some cases, the sediments characteristics can also influence decisions regarding the cleaning equipment. For example, there are cases in which there is a need to clean soft sediments. In those cases smaller diameters may be preferred in order to allow more precise direction of the particles flow.

The invention claimed is:

1. A waterless mixture for cleaning deposits in furnaces, heaters, or boilers, said mixture comprises:

biuret and/or urea;

silica; and melamine particles coated with layer of magnetite iron oxide, wherein the mixture does not contain water.

2. A mixture according to claim 1, wherein the melamine has a particle size of 0.8-2.5 min.

3. A mixture according to claim 1, wherein the melamine has a particle size of 1.8-3.4 mm.

4. A mixture according to claim 3, wherein the thickness of magnetite iron oxide coating, is 10-100 microns.

5. A mixture according to claim 3, wherein the thickness of iron oxide coating is up to 80 microns.

* * * * *